US005165684A

United States Patent [19]

Pratt

[11] Patent Number: 5,165,684

[45] Date of Patent: Nov. 24, 1992

[54] CATCHING GAME WITH REMOVABLE HITTING COVER

[75] Inventor: Kenneth W. Pratt, Ware, Mass.

[73] Assignee: Seneca Sports, Inc., Milford, Mass.

[21] Appl. No.: 851,901

[22] Filed: Mar. 16, 1992

[51] Int. Cl.[5] ..... A63B 67/00; A63B 59/00

[52] U.S. Cl. ..... 273/67 B; 273/346; 273/DIG. 30

[58] Field of Search ..... 273/346, 176 F, 412, 273/58 A, DIG. 19, 67, DIG. 24, 76, DIG. 30

[56] References Cited

U.S. PATENT DOCUMENTS

| | | | |
|---|---|---|---|
| 716,645 | 12/1902 | Ransom | 273/DIG. 24 X |
| 3,032,345 | 5/1962 | Lemelson | 273/340 |
| 3,601,406 | 8/1971 | Glass | 273/176 F |
| 3,857,566 | 12/1974 | Lemelson et al. | 273/346 |
| 3,917,271 | 11/1975 | Lemelson et al. | 273/346 |
| 3,927,881 | 12/1975 | Lemelson et al. | 273/346 |
| 3,999,748 | 12/1976 | Clarke | 273/346 |
| 4,017,076 | 4/1977 | Bai | 273/346 |
| 4,995,617 | 2/1991 | Lee | 273/346 |
| 5,080,374 | 1/1992 | Yu | 273/346 |

FOREIGN PATENT DOCUMENTS

| | | |
|---|---|---|
| 59911 | 12/1985 | Rep. of Korea . |
| 59-22590 | 12/1989 | Rep. of Korea . |

*Primary Examiner*—Mark Graham
*Attorney, Agent, or Firm*—Fish & Richardson

[57] ABSTRACT

Articles for a game of selective hitting and catching includes a mitt consisting of a rigid rear disk, a flexible front catching layer, an intermediate layer of cushioning material between the rigid disk and flexible front catching layer, a ring extending circumferentially about a peripheral edge of the rigid rear disk, and an adjustable strap on a rear surface of disk adapted for attachment of the mitt upon a person's hand. A cover is removably attachable upon the mitt and provides a rigid front hitting surface, the cover having a rim sized for snap fit engagement upon the ring. The mitt retains a ball on contact of the ball with the catching surface by engagement of complementary hook-and-loop elements on the respective catching surface and the ball surface.

8 Claims, 6 Drawing Sheets

CATCHING GAME WITH REMOVABLE HITTING COVER

BACKGROUND OF THE INVENTION

The invention relates to articles for games of hitting or catching.

Articles for catching, consisting of a rigid, concave disk with a flexible, hook-and-loop type front surface and a ball of complementary filamentary surface are known. For example, Bai U.S. Pat No. 4,017,076 describes a target game including a dish-shaped mitt or glove covered by a fabric target spaced from the wall of the mitt. Lee U.S. Pat No. 4,995,617 describes a similar catching mitt in which two cushioning layers of foam are provided between the mitt and front layer.

Yu U.S. Pat No. 5,080,374 describes a racket having an integral handle, with a front racket surface covered with VELCRO or hook-and-loop type material for catching a ball and a rear, hard surface for hitting a ball.

SUMMARY OF THE INVENTION

According to the invention, an article for game of selective hitting and catching of a ball comprises a mitt element comprising a rigid, generally concave rear disk, a flexible front catching layer comprising a surface of hook elements of complementary hook-and-loop type fasteners, an intermediate layer of cushioning material between the rigid rear disk element and the flexible front catching layer, and a ring extending circumferentially about a peripheral edge of the rigid rear disk element, and a cover element removably attachable upon the mitt element and defining a rigid front hitting surface.

Preferred embodiments of the invention may include one or more of the following features. The article further comprises a ball having at least a portion of its surface covered with loop filament elements of complementary hook-and-loop type fasteners, the mitt being adapted to retain the ball upon contact of the ball with the catching surface by engagement of the complementary hook-and-loop elements on the respective catching surface and ball surface. The article further comprises a strap member disposed upon a rear surface of the rigid rear disk and adapted for attachment of the mitt upon a person's hand. Preferably, the strap member is adjustable. The cover element further comprises a rim sized for snap fit engagement upon the ring. The intermediate layer comprises a layer of foam and the intermediate layer is disposed in contact with opposed inner surfaces of the rigid rear disk and the flexible front catching layer.

According to one preferred aspect of the invention, articles for game of selective hitting and catching comprises a mitt element comprising a rigid, generally concave rear disk, a flexible front catching layer comprising a surface of hook elements of complementary hook-and-loop type fasteners, an intermediate layer of cushioning material between the rigid rear disk element and the flexible front catching layer, a ring extending circumferentially about a peripheral edge of the rigid rear disk element, and an adjustable strap member disposed upon a rear surface of the rigid rear disk and adapted for attachment of the mitt upon a person's hand, a cover element removably attachable upon the mitt element and defining a rigid front hitting surface, the cover element comprising a rim sized for snap fit engagement upon the ring, and a ball having at least a portion of its surface covered with loop filament elements of complementary hook-and-loop type fasteners, whereby the mitt is adapted to retain the ball upon contact of the ball with the catching surface by engagement of the complementary hook-and-loop elements on the respective catching surface and ball surface.

In preferred embodiments of this aspect of the invention, the intermediate layer comprises a layer of foam and the intermediate layer is disposed in contact with opposed inner surfaces of the rigid rear disk and the flexible front catching layer.

These and other features and advantages will be seen from the following description of a presently preferred embodiment, and from the claims.

BRIEF DESCRIPTION OF THE DRAWING

We first briefly describe the drawings.

DESCRIPTION OF A PRESENTLY PREFERRED EMBODIMENT

Figure 1:
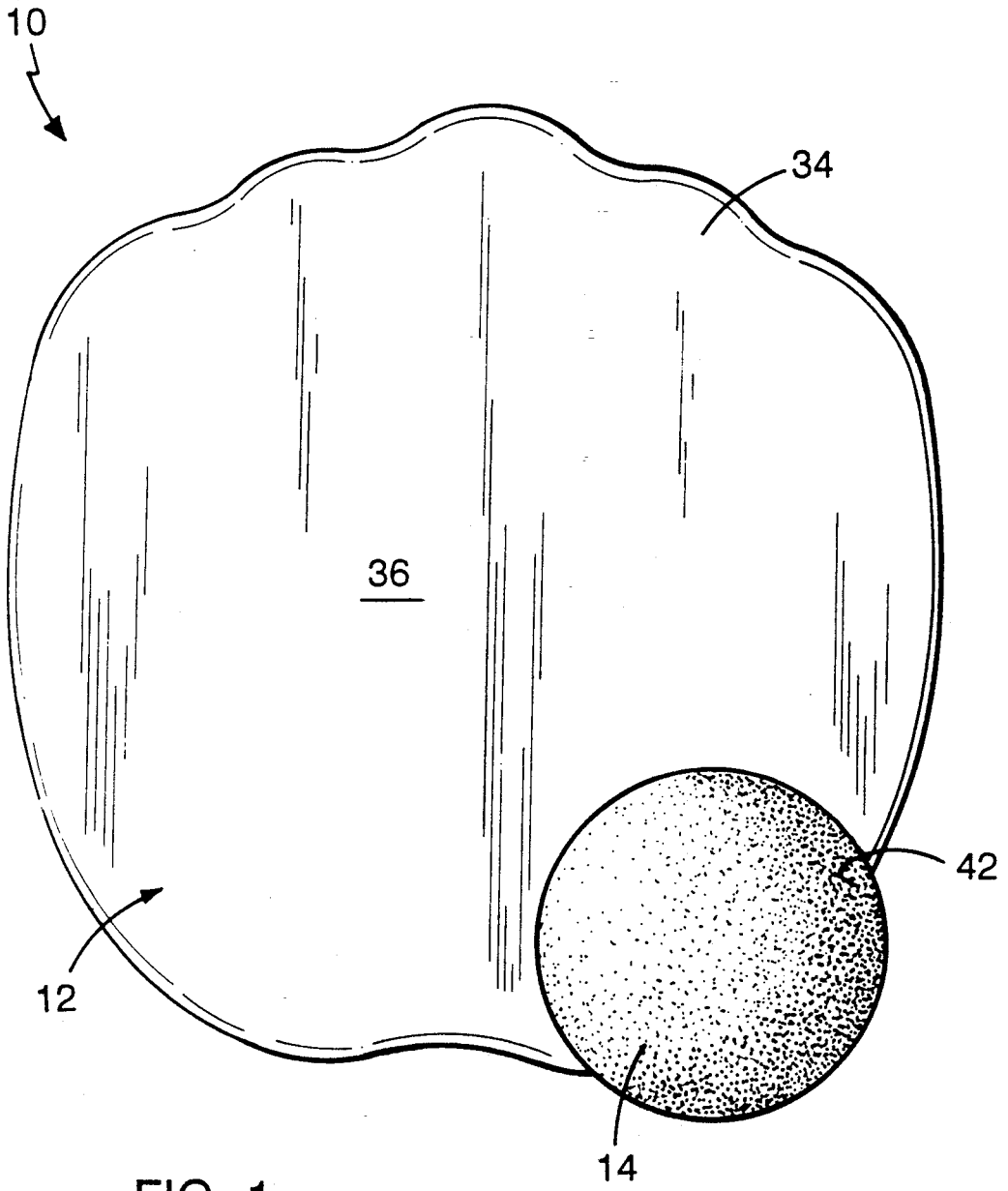
FIG. 1 is a front view of a mitt of the invention with the cover in place for hitting a ball.
Figure 2:
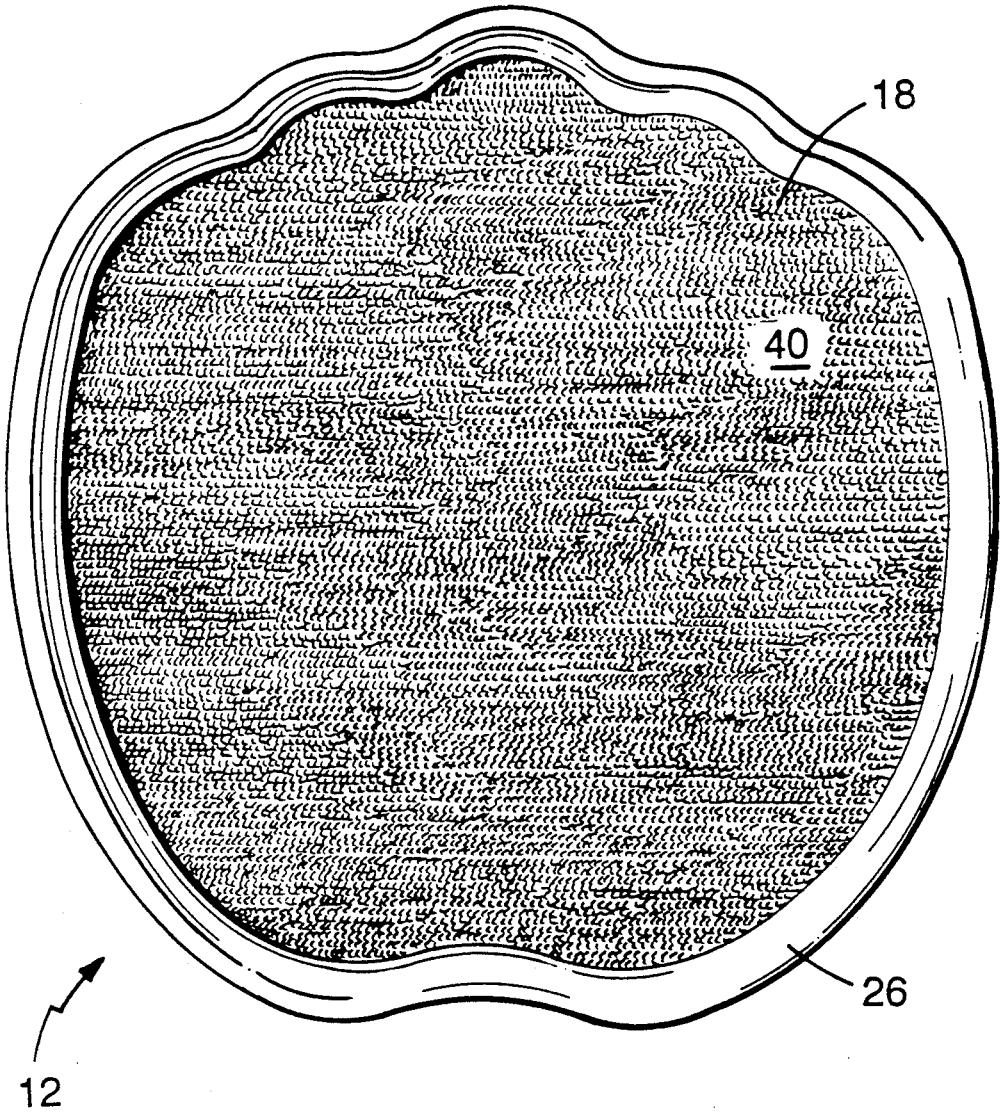
FIG. 2 is a similar view of the mitt of FIG. 1 with the cover removed for catching a ball.

Referring to the drawings, game articles 10 for selective hitting and catching include a mitt 12 and a ball The mitt consists of a rigid, concave rear disk 16 (FIG. 3 et seq.), a flexible front catching layer 18 and an intermediate layer 20 of cushioning material, e.g. a layer of foam, disposed in contact with opposed inner surfaces 22, 24 of the rigid rear disk and flexible front catching layer. A ring 26 extends circumferentially about a peripheral edge 28 of the rigid rear disk 16.

Figure 3:
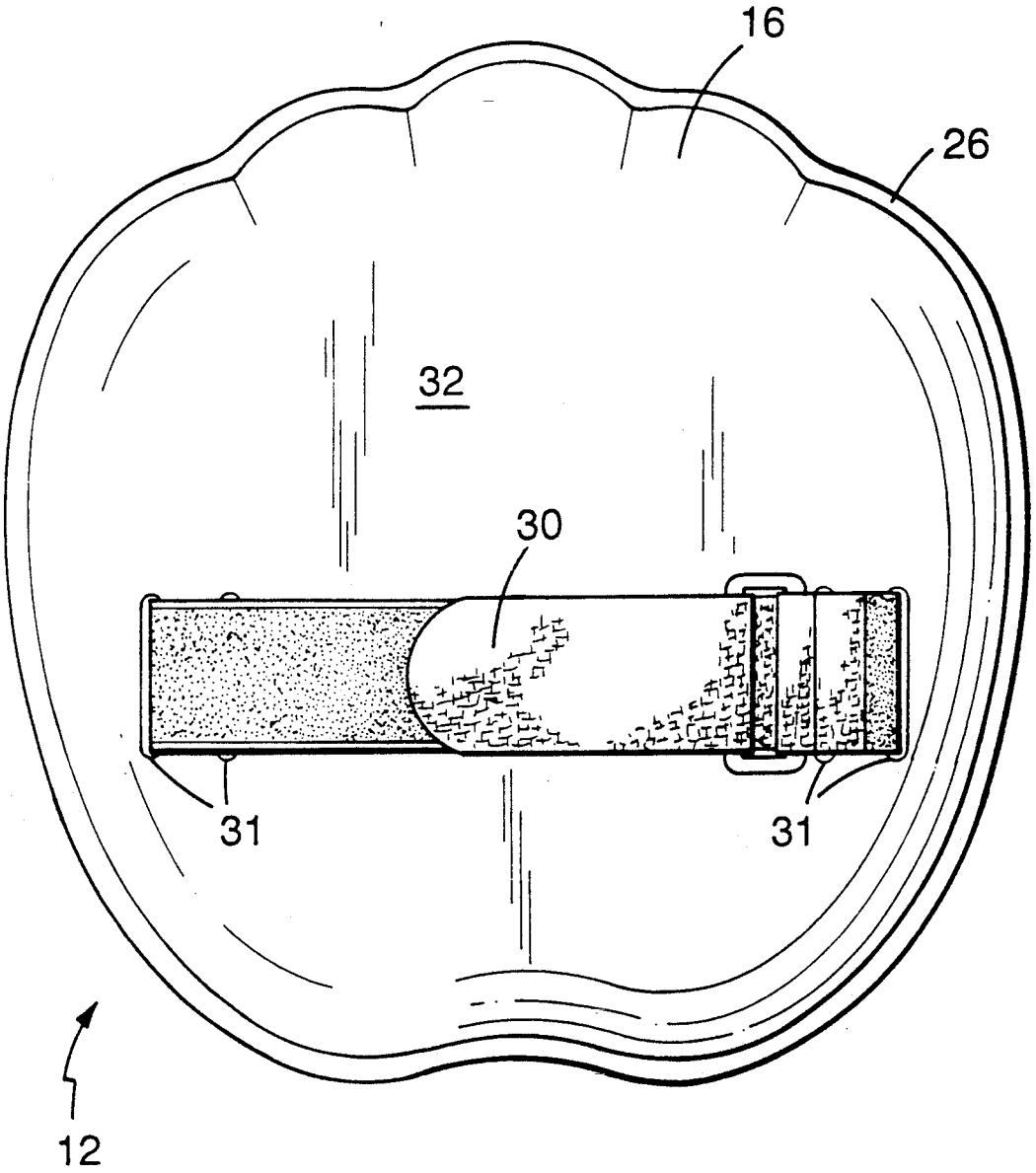
FIG. 3 is a rear view of the mitt of FIG. 1.

Referring to FIG. 3, an adjustable strap 30 (e.g. complementary hook-and-loop type fasteners or elastic) is engaged through slots 31 defined in the rear surface 32 of the rear disk 16 for attachment of the mitt upon a person's hand.

Figure 4:
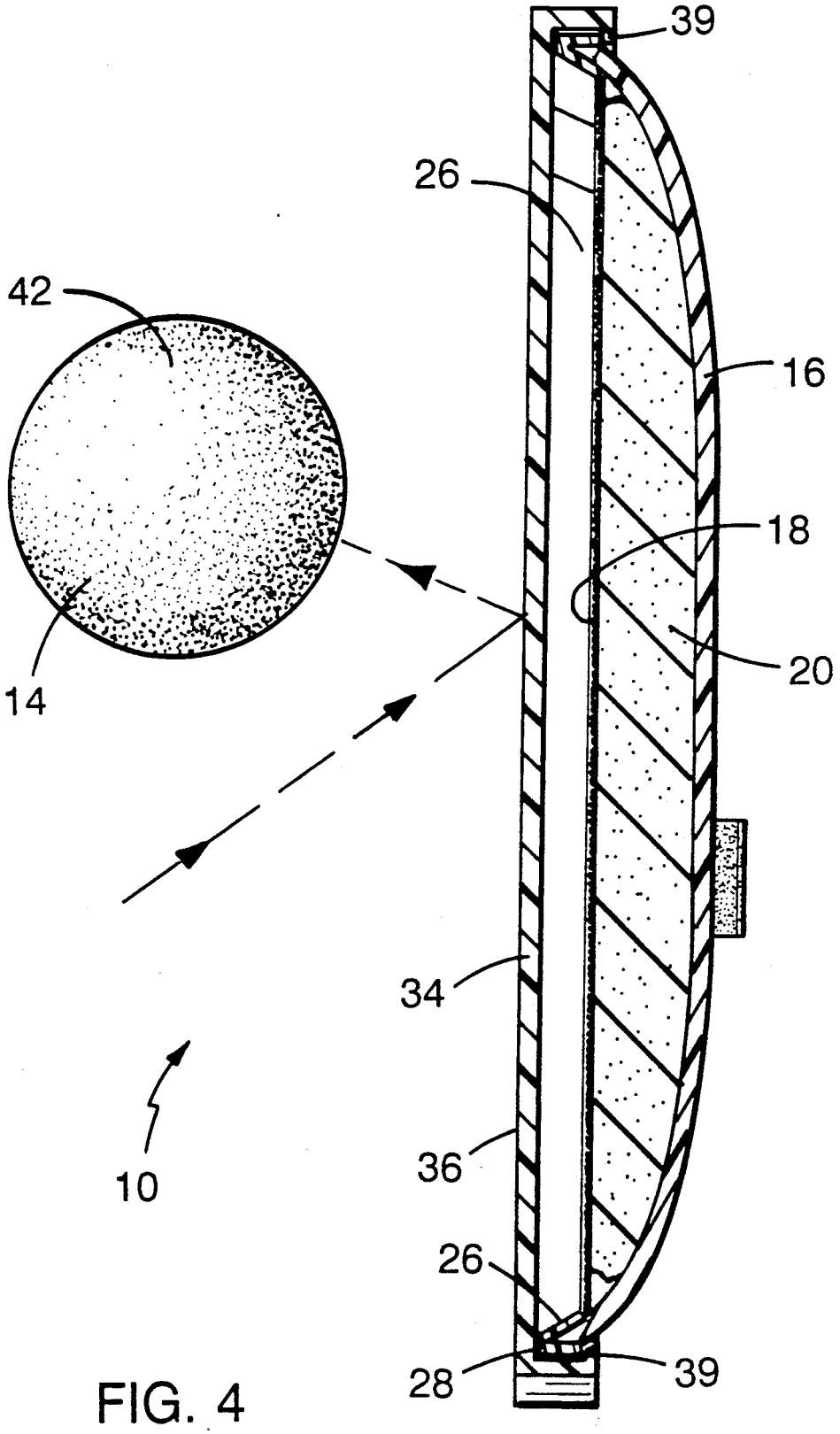
FIG. 4 is side sectional view of the mitt of the invention, taken at the line 4—4 of FIG. 1, and a ball of the invention shown deflected from the hitting surface.

A cover 34, removably attachable upon the mitt 12, defines a rigid generally planar front hitting surface 36 adapted to be disposed in front of and across a catching surface for hitting the ball (FIG. 4). The cover element has a rim 38 with protrusions 39 sized for snap fit engagement over the ring 26 of the mitt.

Figure 5:
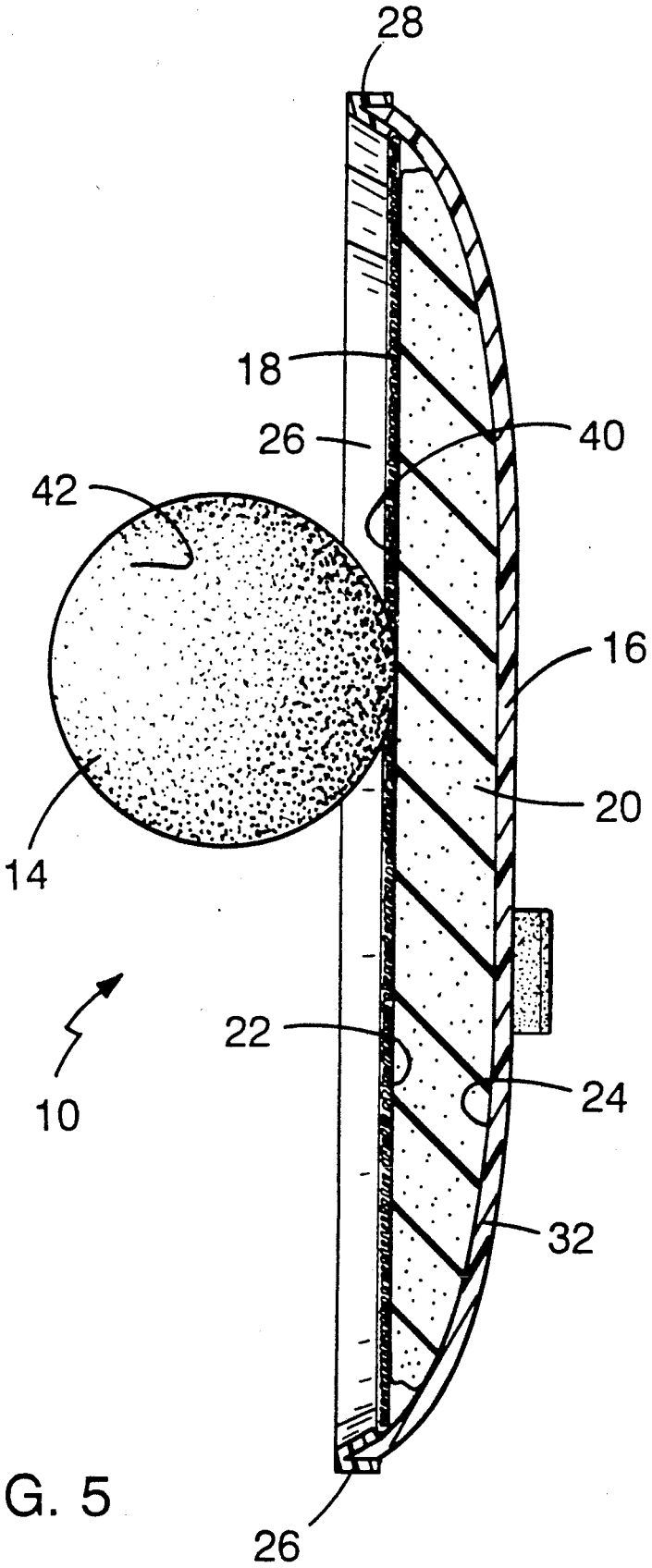
FIG. 5 is similar view of the mitt of the invention, taken at the line 5—5 of FIG. 2, and a ball of the invention shown retained by the catching surface.
Figure 6:
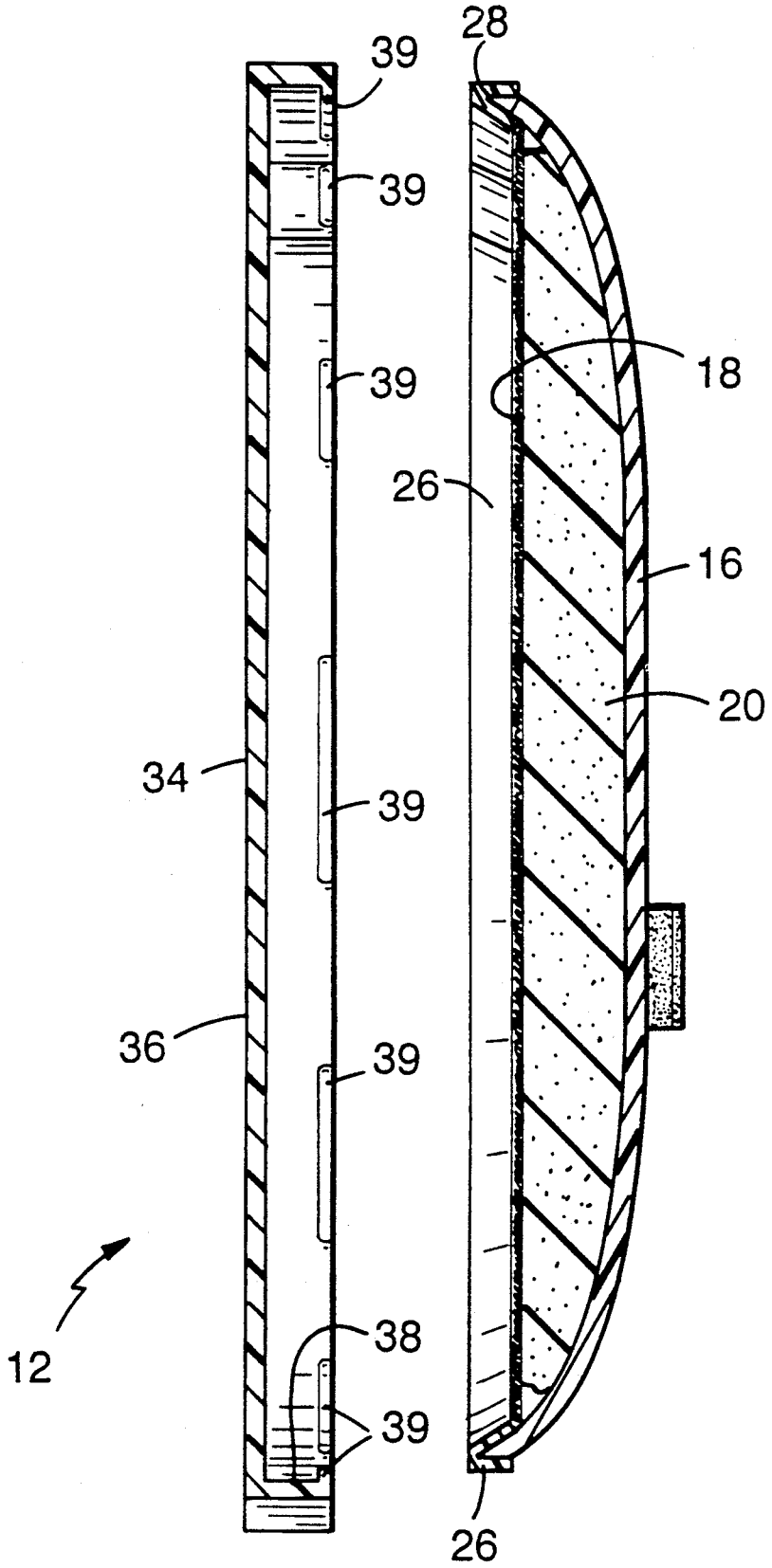
FIG. 6 is similar view of the mitt of the invention, taken at the line 5—5 of FIG. 2, and a ball of the invention 2, respectively.

The front surface 40 of the flexible front catching layer 18 consists of a multiplicity of hook elements of complementary hook-and-loop type fasteners, and the ball 14 has at least a portion of its surface 42 covered with loop filaments also of complementary hook-and-loop type fasteners, whereby the mitt 12 is adapted to retain the ball 14 upon contact of the ball with the catching surface 40 by engagement of the complementary hook-and-loop elements on the respective catching surface 40 and ball surface 42, as shown in FIG. 5.

The invention thus provides articles 10 that permit the selective playing of ball hitting games and catching games by removal and replacement of the cover 34 upon the mitt 12.

Other embodiments are within the following claims.

What is claimed is:

1. Article for game of selective hitting and catching of a ball, comprising a mitt element comprising a rigid, generally concave rear disk, a flexible front catching layer comprising a catching surface of hook elements of complementary hook-and-loop type fasteners, an intermediate layer of cushioning material between said rigid rear disk element and said flexible front catching layer, and a ring extending circumferentially about a peripheral edge of said rigid rear disk element, and a cover element removably attachable upon said mitt element and defining a rigid, generally planar front hitting surface adapted to be disposed in front of and across said catching surface.

2. The article of claim 1 further comprising a ball having at least a portion of its surface covered with loop filament elements of complementary hook-and-loop type fasteners.

said mitt adapted to retain said ball upon contact of said ball with said catching surface by engagement of said complementary hook-and-loop elements on the respective catching surface and ball surface.

3. The article of claim 1 further comprising a strap member disposed upon a rear surface of said rigid rear disk and adapted for attachment of said mitt upon a person's hand.

4. The article of claim 3 wherein said strap member is adjustable.

5. The article of claim 1 wherein said cover element further comprises a rim sized for snap fit engagement upon said ring.

6. The article of claim 1 wherein said intermediate layer comprises a layer of foam and said intermediate layer is disposed in contact with opposed inner surfaces of said rigid rear disk and said flexible front catching layer.

7. Articles for game of selective hitting and catching, comprising a mitt element comprising a rigid, generally concave rear disk, a flexible front catching layer comprising a catching surface of hook elements of complementary hook-and-loop type fasteners, an intermediate layer of cushioning material between said rigid rear disk element and said flexible front catching layer, a ring extending circumferentially about a peripheral edge of said rigid rear disk element, and an adjustable strap member disposed upon a rear surface of said rigid rear disk and adapted for attachment of said mitt upon a person's hand, a cover element removably attachable upon said mitt element and defining a rigid, generally planar front hitting surface adapted to be disposed in front of and across said catching surface, said cover element comprising a rim sized for snap fit engagement upon said ring, and a ball having at least a portion of its surface covered with loop filament elements of complementary hook-and-loop type fasteners, whereby said mitt is adapted to retain said ball upon contact of said ball with said catching surface by engagement of said complementary hook-and-loop elements on the respective catching surface and ball surface.

8. The article of claim 7 wherein said intermediate layer comprises a layer of foam and said intermediate layer is disposed in contact with opposed inner surfaces of said rigid rear disk and said flexible front catching layer.

* * * * *

UNITED STATES PATENT AND TRADEMARK OFFICE

CERTIFICATE OF CORRECTION

PATENT NO. : 5,165,684

DATED : November 24, 1992

INVENTOR(S) : Kenneth W. Pratt

It is certified that error appears in the above-identified patent and that said Letters Patent is hereby corrected as shown below:

Col. 2, line 37; insert --14.-- after "ball".

Signed and Sealed this

Thirtieth Day of November, 1993

*Attest:*

*Attesting Officer*

BRUCE LEHMAN

*Commissioner of Patents and Trademarks*